US011617444B2

(12) United States Patent
Deevers et al.

(10) Patent No.: US 11,617,444 B2
(45) Date of Patent: Apr. 4, 2023

(54) BODY SUPPORT ASSEMBLY AND METHODS FOR THE USE AND ASSEMBLY THEREOF

(71) Applicant: Steelcase Inc., Grand Rapids, MI (US)

(72) Inventors: Nickolaus William Charles Deevers, Holland, MI (US); Kurt R. Heidmann, Grand Rapids, MI (US)

(73) Assignee: STEELCASE INC., Grand Rapids, MI (US)

( * ) Notice: Subject to any disclaimer, the term of this patent is extended or adjusted under 35 U.S.C. 154(b) by 108 days.

(21) Appl. No.: 17/185,332

(22) Filed: Feb. 25, 2021

(65) Prior Publication Data

US 2021/0267375 A1 Sep. 2, 2021

Related U.S. Application Data

(60) Provisional application No. 62/984,042, filed on Mar. 2, 2020.

(51) Int. Cl.
*A47C 7/44* (2006.01)

(52) U.S. Cl.
CPC ..... *A47C 7/445* (2013.01)

(58) Field of Classification Search
CPC ..... A47C 7/445
See application file for complete search history.

(56) References Cited

U.S. PATENT DOCUMENTS

| | | | |
|---|---|---|---|
| 87,184 | A | 2/1869 | Mattson |
| 2,414,978 | A | 1/1947 | Richardson |
| 2,424,753 | A | 7/1947 | Herold |
| 2,711,211 | A | 6/1955 | Tidcombe |
| 2,818,911 | A | 1/1958 | Syak |
| 2,983,505 | A | 5/1961 | Hanslip |
| 3,740,792 | A | 6/1973 | Werner |
| 3,774,960 | A | 11/1973 | Blodee |
| 4,153,293 | A | 5/1979 | Sheldon |
| 4,337,931 | A | 7/1982 | Mundell et al. |
| 4,451,085 | A | 5/1984 | Franck et al. |
| 4,567,615 | A | 2/1986 | Fanti |
| 4,585,272 | A | 4/1986 | Ballarini |
| 4,640,548 | A | 2/1987 | Desanta |
| 4,641,885 | A | 2/1987 | Bräuning |

(Continued)

FOREIGN PATENT DOCUMENTS

| | | |
|---|---|---|
| CH | 243823 | 8/1946 |
| DE | 631 146 | 6/1936 |

(Continued)

OTHER PUBLICATIONS

The International Search Report and Written Opinion of the International Search Authority for Application No. PCT.US2021/019635, dated May 6, 2021, 10 pp.

*Primary Examiner* — Anthony D Barfield
(74) *Attorney, Agent, or Firm* — Crowell & Moring LLP

(57) ABSTRACT

A frame includes laterally spaced apart first and second support locations. A leaf spring has a longitudinal axis and extends between the first and second support locations. The leaf spring includes opposite first and second ends coupled to the frame along the longitudinal axis. A flexible shell is coupled to the frame at a third support location longitudinally spaced apart from the first and second support locations. The flexible shell is coupled to the leaf spring between the first and second support locations.

27 Claims, 6 Drawing Sheets

(56) References Cited

U.S. PATENT DOCUMENTS

| | | | |
|---|---|---|---|
| 4,856,846 | A | 8/1989 | Lohmeyer |
| 4,889,385 | A | 12/1989 | Chadwick et al. |
| 4,895,091 | A | 1/1990 | Elmali et al. |
| 4,911,501 | A | 3/1990 | Decker et al. |
| 4,988,145 | A | 1/1991 | Engel |
| 5,022,709 | A | 6/1991 | Marchino |
| 5,046,780 | A | 9/1991 | Decker et al. |
| 5,154,485 | A | 10/1992 | Fleishman |
| 5,195,801 | A | 3/1993 | Franck et al. |
| 5,224,758 | A | 7/1993 | Takamatsu et al. |
| 5,249,839 | A | 10/1993 | Faiks et al. |
| 5,267,777 | A | 12/1993 | Valtri |
| 5,282,285 | A | 2/1994 | de Gelis et al. |
| 5,356,199 | A | 10/1994 | Elzenbeck et al. |
| 5,403,067 | A | 4/1995 | Rajaratnam |
| 5,417,473 | A | 5/1995 | Bräuning |
| 5,517,877 | A | 5/1996 | Hancock |
| 5,518,294 | A | 5/1996 | Ligon, Sr. et al. |
| 5,580,127 | A | 12/1996 | Piretti |
| 5,697,673 | A | 12/1997 | Favaretto |
| 5,774,911 | A | 7/1998 | Stube et al. |
| 5,775,774 | A | 7/1998 | Okano |
| 5,806,931 | A | 9/1998 | Kogai |
| 5,902,012 | A | 5/1999 | Han |
| 5,951,109 | A | 9/1999 | Roslund, Jr. et al. |
| 6,065,803 | A | 5/2000 | Li et al. |
| 6,106,438 | A | 8/2000 | Dean |
| 6,318,800 | B1 | 11/2001 | DeKraker |
| 6,357,826 | B1 | 3/2002 | Gabas et al. |
| 6,409,268 | B1 | 6/2002 | Cvek |
| 6,616,228 | B2 | 9/2003 | Heidmann |
| 6,637,876 | B2 | 10/2003 | Hori |
| 6,701,550 | B2 | 3/2004 | Baeriswyl |
| 6,729,688 | B2 | 5/2004 | Erne |
| 6,755,467 | B1 | 6/2004 | Chu |
| 6,779,841 | B2 | 8/2004 | Eckendofrf |
| 6,793,289 | B2 | 9/2004 | Kuster et al. |
| 6,811,218 | B2 | 11/2004 | Deimen et al. |
| 6,820,933 | B2 | 11/2004 | Fereira Da Silva |
| 6,848,744 | B1 | 2/2005 | Rafter et al. |
| 6,869,142 | B2 | 3/2005 | Heidmann et al. |
| 6,935,690 | B2 | 8/2005 | Lucci et al. |
| 6,986,549 | B2 | 1/2006 | Kniese |
| 6,991,291 | B2 | 1/2006 | Knoblock et al. |
| 7,004,543 | B2 | 2/2006 | Caruso et al. |
| 7,032,971 | B2 | 4/2006 | Williams |
| 7,131,700 | B2 | 11/2006 | Knoblock et al. |
| 7,165,811 | B2 | 1/2007 | Bodnar et al. |
| 7,237,841 | B2 | 7/2007 | Norman et al. |
| 7,320,503 | B2 | 1/2008 | Eysing |
| 7,422,287 | B2 | 9/2008 | Heidmann et al. |
| 7,441,839 | B2 | 10/2008 | Pennington et al. |
| 7,568,768 | B1 | 8/2009 | Tsai |
| 7,604,298 | B2 | 10/2009 | Peterson et al. |
| 7,622,579 | B2 | 11/2009 | Gaul et al. |
| 7,625,045 | B2 | 12/2009 | Hatcher et al. |
| 7,648,201 | B2 | 1/2010 | Eysing |
| 7,712,834 | B2 | 5/2010 | Knoblock et al. |
| 7,794,017 | B2 | 9/2010 | Kan et al. |
| 7,806,478 | B1 | 10/2010 | Cvek |
| 7,841,666 | B2 | 11/2010 | Schmitz et al. |
| 7,857,388 | B2 | 12/2010 | Bedford et al. |
| 7,857,390 | B2 | 12/2010 | Schmitz et al. |
| 7,874,619 | B2 | 1/2011 | Harley |
| 7,909,402 | B2 | 3/2011 | Chu et al. |
| 7,922,248 | B2 | 4/2011 | Aldrich et al. |
| 7,926,879 | B2 | 4/2011 | Schmitz et al. |
| 7,971,935 | B2 | 7/2011 | Saez et al. |
| 8,029,060 | B2 | 10/2011 | Parker et al. |
| 8,113,581 | B2 | 2/2012 | Liu |
| 8,282,169 | B2 | 10/2012 | Schmitz et al. |
| 8,419,133 | B2 | 4/2013 | Holt et al. |
| 8,424,968 | B2 | 4/2013 | Humer et al. |
| 8,745,783 | B2 | 6/2014 | Jansen |
| 8,773,641 | B2 | 7/2014 | Hoogendam et al. |
| 8,840,178 | B2 | 9/2014 | Mitsuoka et al. |
| 8,845,024 | B2 | 9/2014 | Beyer et al. |
| 8,926,016 | B2 | 1/2015 | Behar et al. |
| 8,939,507 | B2 | 1/2015 | Thomaschewski et al. |
| 8,973,995 | B2 | 3/2015 | Donati |
| 8,998,322 | B2 | 4/2015 | Horiki et al. |
| 8,998,339 | B2 | 4/2015 | Peterson et al. |
| 9,022,475 | B2 | 5/2015 | Brncick et al. |
| 9,107,504 | B2 | 8/2015 | Haas |
| 9,211,014 | B2 | 12/2015 | Schmitz et al. |
| 9,357,839 | B1 | 6/2016 | Grove |
| 9,415,701 | B2 | 8/2016 | Wrong et al. |
| 9,486,081 | B2 | 11/2016 | Sander et al. |
| 9,498,066 | B2 | 11/2016 | Christianson et al. |
| 9,504,325 | B2 | 11/2016 | Sander et al. |
| 9,510,684 | B2 | 12/2016 | Schmitz et al. |
| 9,538,849 | B2 | 1/2017 | Beyer et al. |
| 9,622,579 | B2 | 4/2017 | Wilkinson et al. |
| 9,833,074 | B2 | 12/2017 | Bohmann et al. |
| 9,861,201 | B2 | 1/2018 | Battery et al. |
| 10,017,082 | B2 | 7/2018 | Zwaan |
| 10,098,466 | B2 | 10/2018 | Donati |
| 10,111,525 | B2 | 10/2018 | Sander et al. |
| 10,194,750 | B2 | 2/2019 | Ludwig et al. |
| 10,321,763 | B2 | 6/2019 | Bonneywell |
| 2001/0043003 | A1 | 11/2001 | Knoblock et al. |
| 2002/0109384 | A1 | 8/2002 | Hansen |
| 2003/0047982 | A1 | 3/2003 | Ball et al. |
| 2004/0007910 | A1 | 1/2004 | Skelly |
| 2004/0164472 | A1 | 8/2004 | Kobelev |
| 2005/0264071 | A1 | 12/2005 | Costaglia |
| 2005/0275263 | A1 | 12/2005 | Norman et al. |
| 2006/0181126 | A1 | 8/2006 | Eysing |
| 2007/0102987 | A1 | 5/2007 | Chen |
| 2007/0108831 | A1 | 5/2007 | Ueda |
| 2008/0079298 | A1 | 4/2008 | Whelan et al. |
| 2009/0039033 | A1 | 2/2009 | Kee et al. |
| 2009/0096266 | A1 | 4/2009 | Tai |
| 2009/0261644 | A1 | 10/2009 | Piretti |
| 2010/0141002 | A1 | 6/2010 | Kurrasch et al. |
| 2010/0164270 | A1 | 7/2010 | Akutsu |
| 2012/0061988 | A1 | 3/2012 | Jaranson et al. |
| 2013/0169017 | A1 | 7/2013 | Masunaga et al. |
| 2014/0077542 | A1 | 3/2014 | Vander Veen et al. |
| 2014/0110983 | A1 | 4/2014 | Sander et al. |
| 2014/0152064 | A1 | 6/2014 | Sander et al. |
| 2016/0029801 | A1 | 2/2016 | Potrykus et al. |
| 2016/0296026 | A1 | 10/2016 | Ludwig et al. |
| 2018/0332967 | A1 | 11/2018 | Jin et al. |
| 2019/0038033 | A1 | 2/2019 | Schmitz et al. |
| 2019/0045934 | A1 | 2/2019 | Deisig et al. |
| 2020/0085194 | A1 | 3/2020 | Maier et al. |

FOREIGN PATENT DOCUMENTS

| | | | |
|---|---|---|---|
| DE | 38 34 614 | A1 | 4/1990 |
| DE | 44 24 096 | A1 | 1/1996 |
| DE | 297 04 906 | U1 | 7/1997 |
| DE | 196 11 345 | A1 | 9/1997 |
| DE | 197 14 546 | A1 | 10/1998 |
| DE | 20 2006 005 645 | U1 | 8/2007 |
| DE | 10 2007 026 327 | A | 12/2008 |
| DE | 20 2010 008 739 | U1 | 11/2011 |
| EP | 0 250 199 | A1 | 12/1987 |
| EP | 0 284 272 | A1 | 9/1988 |
| EP | 1 493 618 | A2 | 1/2005 |
| EP | 1 579 787 | A1 | 9/2005 |
| EP | 2 070 446 | B1 | 6/2008 |
| EP | 2 100 539 | A1 | 9/2009 |
| EP | 2 520 199 | A1 | 11/2012 |
| EP | 3 409 144 | A1 | 5/2018 |
| JP | 2000-116458 | A | 4/2000 |
| JP | 2009-268780 | A | 11/2009 |
| JP | 2013-132403 | A | 7/2013 |
| WO | WO 2005/117652 | A1 | 12/2005 |
| WO | WO 2006/107214 | A1 | 10/2006 |
| WO | WO 2007/095960 | A1 | 8/2007 |
| WO | WO 2008/000295 | A1 | 1/2008 |
| WO | WO 2009/033535 | A1 | 3/2009 |

(56) References Cited

FOREIGN PATENT DOCUMENTS

| | | | |
|---|---|---|---|
| WO | WO 2013/083562 | A1 | 6/2013 |
| WO | WO 2016/124317 | A1 | 8/2016 |
| WO | WO 2016/124328 | A1 | 8/2016 |
| WO | WO 2020/007411 | A1 | 1/2020 |

BODY SUPPORT ASSEMBLY AND METHODS FOR THE USE AND ASSEMBLY THEREOF

This application claims the benefit of U.S. Provisional Application No. 62/984,042, filed Mar. 2, 2020 and entitled "Body Support Assembly And Methods For The Use And Assembly Thereof," the entire disclosure of which is hereby incorporated herein by reference.

FIELD OF THE INVENTION

The present application relates generally to a body support assembly, for example a chair, and in particular to a backrest assembly and/or seat assembly incorporated into the body support assembly, together with methods for the use and assembly thereof.

BACKGROUND

Chairs, and in particular office chairs, may have a flexible body support member, for example a backrest, which may be configured as a shell or with a suspension material, such as a mesh fabric, that is stretched across a frame. The body support member may flex, for example in response to a load applied by a user against a lumbar region of the backrest. To accommodate such flexing, various mechanisms may be incorporated into the assembly to allow for displacement of portions of the body support member while also providing a biasing force to support the user. These mechanisms may be relatively complicated and expensive.

SUMMARY

The present invention is defined by the following claims, and nothing in this section should be considered to be a limitation on those claims.

In one aspect, one embodiment of a body support member includes a frame, e.g., a backrest frame, having laterally spaced apart first and second support locations. A leaf spring has a longitudinal axis and extends between the first and second support locations. The leaf spring includes opposite first and second ends coupled to the frame along the longitudinal axis. A flexible shell is coupled to the frame at a third support location longitudinally spaced apart from the first and second support locations. The flexible shell is coupled to the leaf spring between the first and second support locations.

In various embodiments, the leaf spring may be simply supported by, or fixedly connected to, the frame at the first and second locations. Various methods of using and assembling the body support assembly are also provided.

The various embodiments of the body support assembly and methods provide significant advantages over other body support assemblies and methods. For example and without limitation, the leaf spring provides both support and energy for the body support member.

The foregoing paragraphs have been provided by way of general introduction, and are not intended to limit the scope of the claims presented below. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
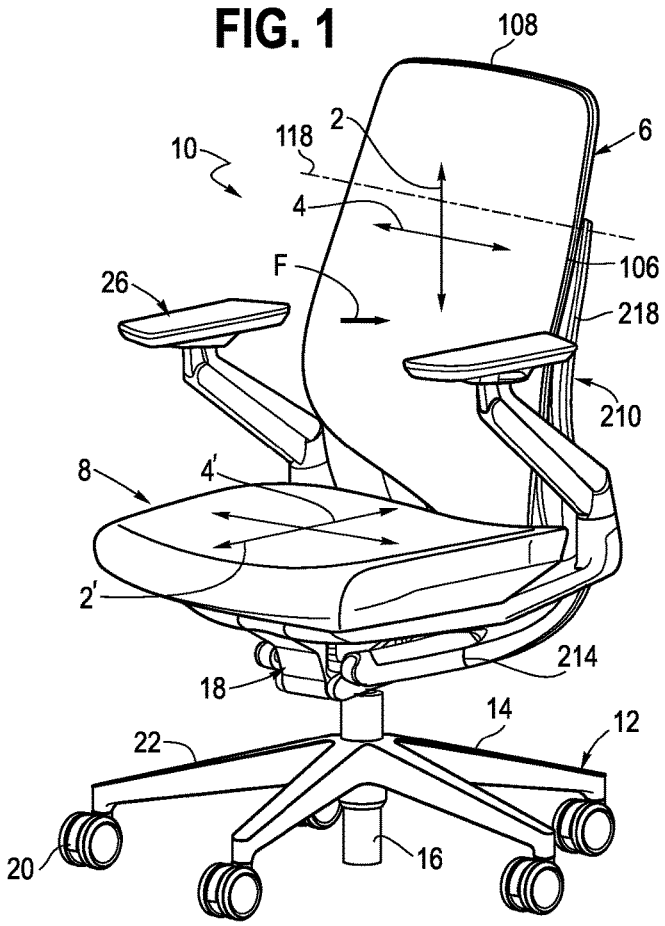
FIG. 1 is a front perspective view of a first embodiment of a body support assembly.

It should be understood that the term "plurality," as used herein, means two or more. The term "longitudinal," as used herein means of or relating to a length or lengthwise direction 2, 2', for example a direction running from the bottom of a backrest assembly 6 to the top thereof, or vice versa, or from the front of a seat assembly 8 to the rear thereof, or vice versa. The term "lateral," as used herein, means situated on, directed toward or running in a side-to-side direction 4 of a body support assembly 10, shown in one embodiment as an office chair including the backrest assembly 6 and seat assembly 8. It should be understood that the body support assembly may be configured as any structure that supports a body, including without limitation automotive, aircraft and mass-transit seating, beds, home furnishings (including sofas and chairs), and other similar and suitable structures. In one embodiment of a backrest assembly disclosed below, a lateral direction 4 corresponds to a horizontal direction and a longitudinal direction 2 corresponds to a vertical direction, while in one embodiment of a seat assembly, the longitudinal direction 2' corresponds to a horizontal direction. The lateral direction 4 may be referred to as an X direction, while the longitudinal direction 2, 2' refers to a Y direction and a Z direction is orthogonal to the body support surface of a respective one of the backrest and seat assemblies 6, 8.

The term "coupled" means connected to or engaged with, whether directly or indirectly, for example with an intervening member, and does not require the engagement to be fixed or permanent, although it may be fixed or permanent. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first direction may be the same as a second direction, with each simply being applicable to different components. The terms "upper," "lower," "rear," "front," "fore," "aft," "vertical," "horizontal," "right," "left," and variations or derivatives thereof, refer to the orientations of an exemplary body support assembly 10, shown as a chair in FIGS. 1-3, from the perspective of a user seated therein. The term "transverse" means non-parallel. The term "outwardly" refers to a direction facing away from a centralized location, for example the phrase "radially outwardly" refers to a feature diverging away from a centralized location, for example the middle or interior region of a seat or backrest, and lies generally in the X Y plane defined by the lateral and longitudinal directions 2, 2', 4, 4'. It should be understood that features or components facing or extending "outwardly" do not necessarily originate from the same centralized point, but rather generally emanate outwardly and exteriorly along a non-tangential vector. Conversely, the term "inwardly" refers to a direction facing toward the centralized or interior location.

The term "textile material" refers to a flexible material made of a network of natural or artificial fibers (yarn, monofilaments, thread, etc.). Textile materials may be formed by weaving, knitting, crocheting, knotting, felting, or braiding. Textile materials may include various furniture upholstery materials, which may be used for example to cover a foam cushion, and/or suspension materials, which may be stretched in tension across an opening to support a user.

Figure 2:
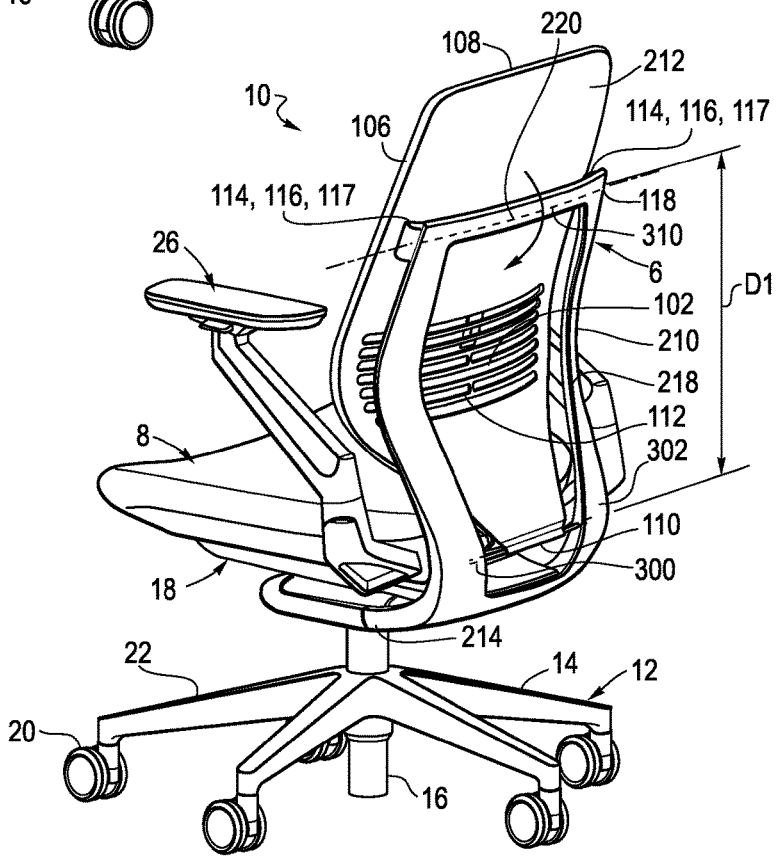
FIG. 2 is a rear perspective view of the body support assembly shown in FIG. 1.
Figure 3:
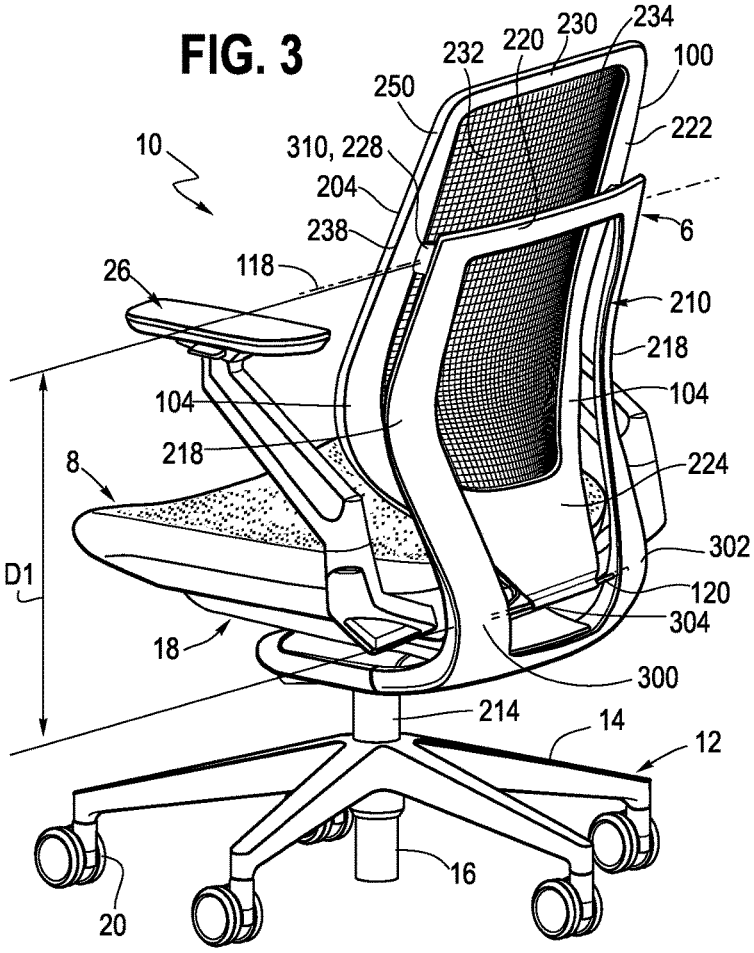
FIG. 3 is rear perspective view of a second embodiment of a body support assembly.

Body Support Assembly:

Referring to FIGS. 1-3, the body support assembly 10 is shown as including a tilt control assembly 18, a base structure 12 and the backrest and seat assemblies 6, 8. In one embodiment, the base structure 12 includes a leg assembly 14 and a support column 16 coupled to and extending upwardly from the leg assembly. The tilt control assembly 18 is supported by and coupled to a top of the support column 16. The leg assembly may alternatively be configured as a fixed structure, for example a four legged base, a sled base or other configuration. In one embodiment, the support column 16 may be height adjustable, including for example and without limitation a telescopic column with a pneumatic, hydraulic or electro-mechanical actuator. The leg assembly 14 includes a plurality of support legs 22 extending radially outwardly from a hub surrounding the support column. Ends of each support leg may be outfitted with a caster, glide or other floor interface member 20.

A pair of armrest assemblies 26 are coupled to the tilt control assembly 18. Various user interface controls are provided to actuate and/or adjust the height of the seat, including for example an actuation lever pivotally coupled to the armrest assembly, or to control the tension and/or return force of the tilt control assembly 18.

Tilt Control Assembly:

Referring to FIGS. 1-6, the backrest and seat assemblies 6, 8 may be operably coupled to the tilt control assembly 18, which controls the movement thereof, for example during recline. One embodiment of a suitable tilt control assembly is disclosed in U.S. Pat. No. 9,826,839, entitled "Chair Assembly with Upholstery Covering," the entire disclosure of which is hereby incorporated herein by reference. The tilt control assembly may include a plurality of rigid control links, which may be mechanically connected, for example via pivot pins, to form a linkage assembly, including for example a four-bar linkage. In operation, a user can move or recline the backrest and seat assemblies 6, 8 from an upright position to a reclined position.

Backrest Assembly:

Referring to FIGS. 1-6, the backrest assembly 6 includes a back frame 210 and a back support 212 or support frame 100. The back frame 210 is relative rigid, meaning it does not substantially flex during recline. The back frame 210 has a lower portion 214 that is connected to the rear portion of the tilt control assembly 18. The lower portion 214, configured for example as a pair of laterally spaced lower support arms, may extend generally horizontally in the longitudinal direction 2'. The back frame 210 is pivotable rearwardly relative to the base 12 during recline. A pair of laterally spaced uprights 218 extend upwardly from the lower portion 214. The back frame 210 further includes an upper cross member 220 extending between and connecting upper ends of the uprights 218.

A back support 212 (FIGS. 1, 2 and 4-6) or support frame 100 (FIG. 3) is flexible, and includes flex regions 102, 104 allowing it to bend and deflect in response to the user reclining in the body support structure. In a first embodiment, the back support 212 is configured as a flexible shell having opposite side edges 106 that are positioned laterally outwardly from the uprights 218, a top edge 108 that is positioned vertically above the cross member 220 and a bottom portion 110. A plurality of longitudinally spaced and laterally extending slots 112 are positioned in lower lumbar region, or flex region 102, of the shell such that the lumbar region is provided with more flexibility than the remainder than other portions of the shell, for example the thoracic or sacral regions. The lumbar flex region 102 is provided with a forwardly facing convex shape and surface, with the flex region capable of being flexed to provide more or less curvature and associated support to the user. A pair of pivot mounts 114 are coupled to and extend rearwardly from the shell. The frame includes a corresponding pair of pivot mounts 116, which may be coupled to the uprights or the cross member, and which are pivotally coupled to the pivot mounts on the shell to define a pivot joint 117, whether by way of a pivot pin, ball and socket joint, or other configuration that provides for pivoting of the back support 212 shell about a horizontal pivot axis 118. In one embodiment, the pivot joint includes the pivot structure disclosed in U.S. Pat. No. 9,826,839, the entire disclosure of which is hereby incorporated herein by reference. The back support 212 shell may also pivot about other axes depending on the configuration of the pivot joint.

In the embodiment of FIG. 3, the support frame 100 includes a pair of laterally spaced uprights 222, each having a forwardly facing convex bow shape, or curvature, at a first location proximate a lumbar region of the back support, which defines a flex region capable of being flexed to provide more or less curvature and associated support to the user. A bottom portion 224 extends between and connects the uprights, and terminates at a bottom edge 120.

The uprights 222 of the back support are coupled to the uprights 218 of the back frame with connectors 228. The back support 212 is pivotable with the back frame 210, for example about axis 118. In one embodiment, the uprights may be pivotally connected with a mechanical pivot joint, defining the connector, including for example the pivot structure disclosed in U.S. Pat. No. 9,826,839, the entire disclosure of which is hereby incorporated herein by reference. The pivot joint may be configured as any of a pivot pin, ball and socket joint, or other configuration that provides for pivoting of the shell about a horizontal pivot axis 118.

The support frame 100 includes an upper member 230 extending between and connected to upper ends of the pair of second uprights 222, and the bottom portion 224 extends between and is connected to the lower ends of the pair of second uprights. The upper member 230, uprights 222 and the bottom portion 224 define a central opening 232. A suspension material 234 is stretched across the central opening 232 and is secured to the support frame 100, for example with a stay disposed in a peripheral groove defined by the support frame.

Specifically, the upper member 230, the bottom portion 224 and the pair of second uprights 222 have a peripheral edge 238 defining a peripheral groove 244. The suspension material 234 includes at least one stay 250, configured as a ring in one embodiment, secured along a peripheral edge portion of the suspension member, wherein the at least one stay is disposed in the groove 244. The stay 250 may be held by friction alone, without any auxiliary support material such as adhesive.

Energy, for example thermal energy or heat applied by radiation or convection, may be applied to the suspension material 234, causing the suspension material to shrink and create tension therein. As the suspension material shrinks, the suspension material is put in tension across the opening 234 and the stay 250 is anchored in the grooves 244.

The back frame 210 has a pair of laterally spaced apart first and second support locations 300, 302 defined at lower ends of the uprights 218. For example, the support locations may include an opening or aperture positioned on an inner side surface of each upright, with a cavity defined in the upright, as shown for example in FIGS. 8-11. A leaf spring 304 has a longitudinal axis 306 and extends between the first and second support locations 300, 302. The leaf spring 304 has opposite first and second ends 308, 312 coupled to the back frame, or uprights 218, along the longitudinal axis at the support locations 300, 302, meaning the connection between the frame and leaf spring, and any movement between the leaf spring and support locations, is coincident with the longitudinal axis 306. The longitudinal axis is defined along a centerline of the leaf spring, and may be linear or curvilinear depending on the configuration of the leaf spring. For example, the leaf spring 304 may bend flex, rotate and/or translate relative to the uprights about and along the longitudinal axis 306, and there is no offset between the axis of the leaf spring and the connection axis 306' with the back frame at the first and second locations.

The flexible shell, or back support 212, is coupled to the back frame at a third support location 310, defined by the pivot mounts 114, 116 or connector 228, with the third support 310 being longitudinally spaced apart from the first and second support locations 300, 302, e.g., a distance D1, wherein the flexible shell is coupled to the leaf spring between the first and second support locations, for example along a center portion 314. As noted, the third support location may include a pair of laterally spaced third support locations. In one embodiment, the back support 212 and support frame 100 are supported exclusively by the back frame at the first, second and third support locations 300, 302, 310, meaning that the back support 212 and support frame 100 are not supported by the back frame between the first/second and third locations. Of course, in other embodiments, the back support and support frame may be supported at other locations by the back frame.

Figure 4:
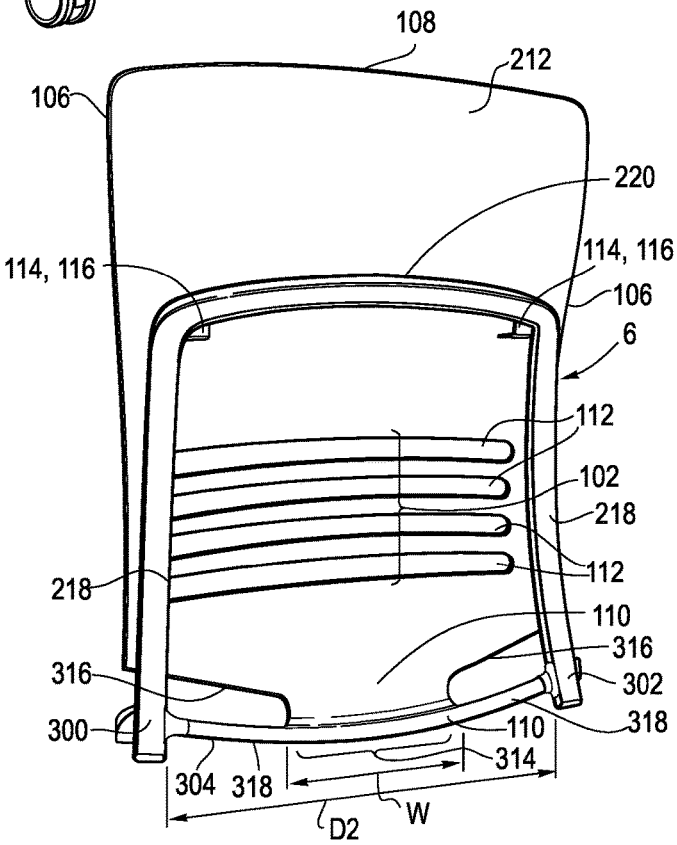
FIG. 4 is a rear view of a backrest incorporated into the first embodiment of the body support assembly.
Figure 5:
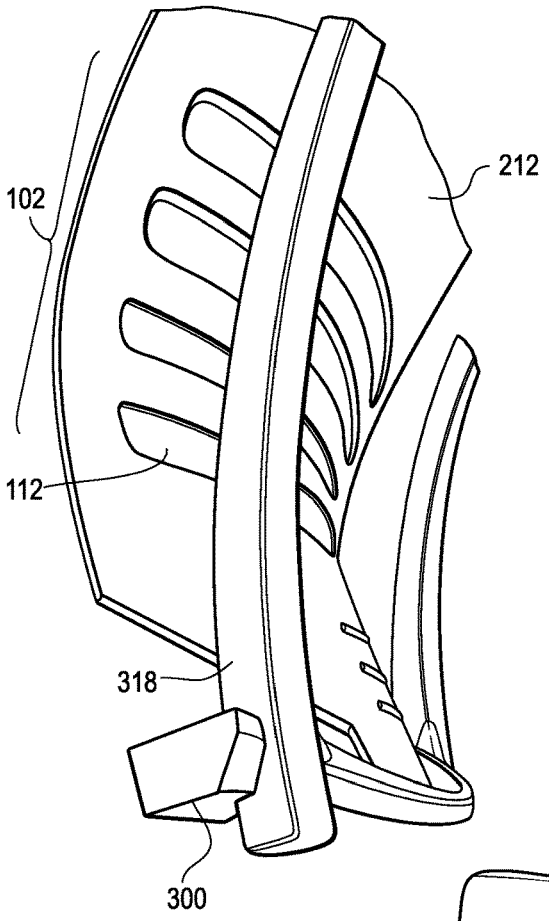
FIG. 5 is a partial side view of the backrest shown in FIG. 4.
Figure 6:
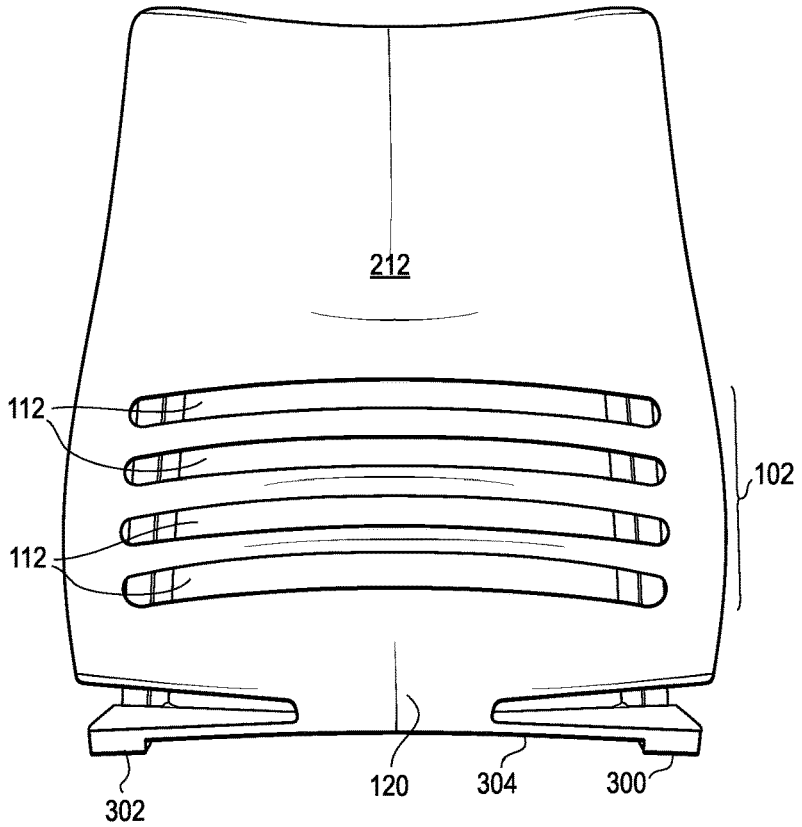
FIG. 6 is a front view of the backrest shown in FIG. 4.

As shown in FIG. 4, the bottom portion of the flexible shell may include a center portion 314, or arm, that extends downwardly in the longitudinal direction and is coupled to the leaf spring at an intermediate location between the support locations. The arm may have a width W less than the distance D2 between the support locations. Accordingly, outboard portions 316 of the bottom edge may define a free edge, meaning they are not supported or otherwise connected to the leaf spring or other structure. A pair of openings are defined between the leaf spring 304 and outboard portions 316. The width W of the center portion 314 affects the amount of twist the lower portion of the backrest may undergo about the longitudinal axis 2, for example in response to a user twisting side-to-side about their spine. A reduced width W allows for greater twisting. Of course, it should be understood that W may be the same as D2, for example if the back support, or flexible shell, may flex with the leaf spring, but without the back support being coupled directly to the back frame. In other embodiments, the ratio of W/D2 may be 0.75 or less, for example 0.50 or less, 0.33 or less, or as little as 0.10 or less. It should be understood that the central portion may be configured as a plurality of laterally spaced and longitudinally extending arms extending between the back support and the leaf spring.

Figure 7:
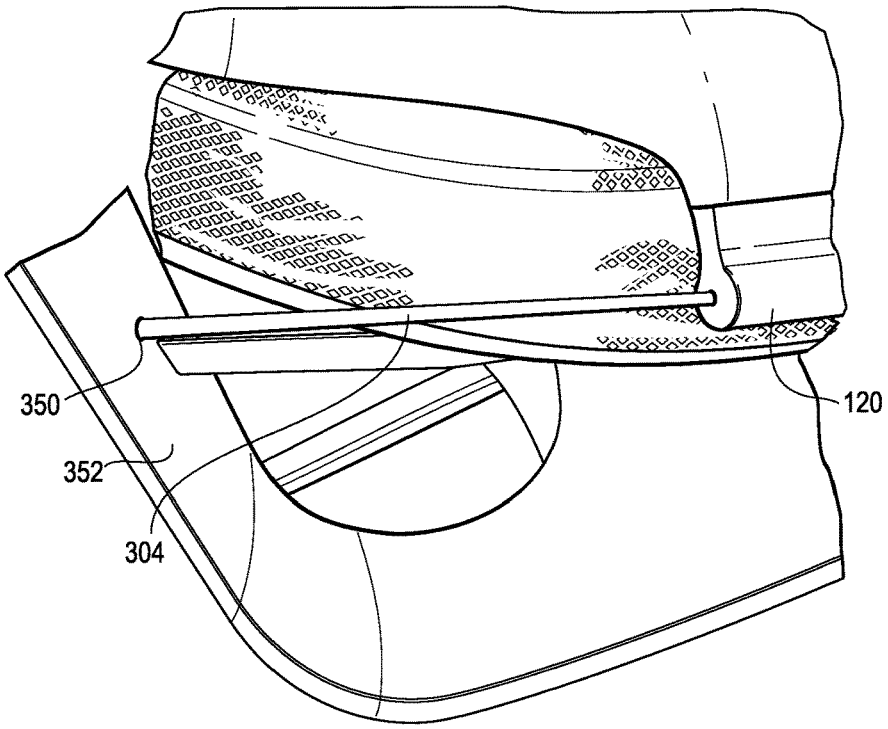
FIG. 7 is a left side partial rear view of another embodiment of the backrest.
Figure 8:
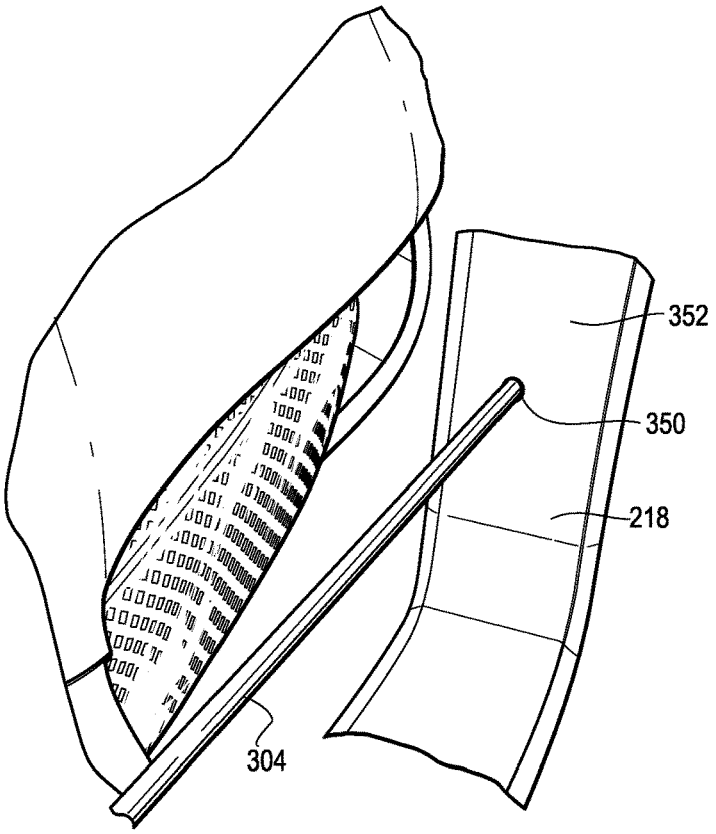
FIG. 8 is a right side partial rear view of the backrest shown in FIG. 7.
Figure 9:
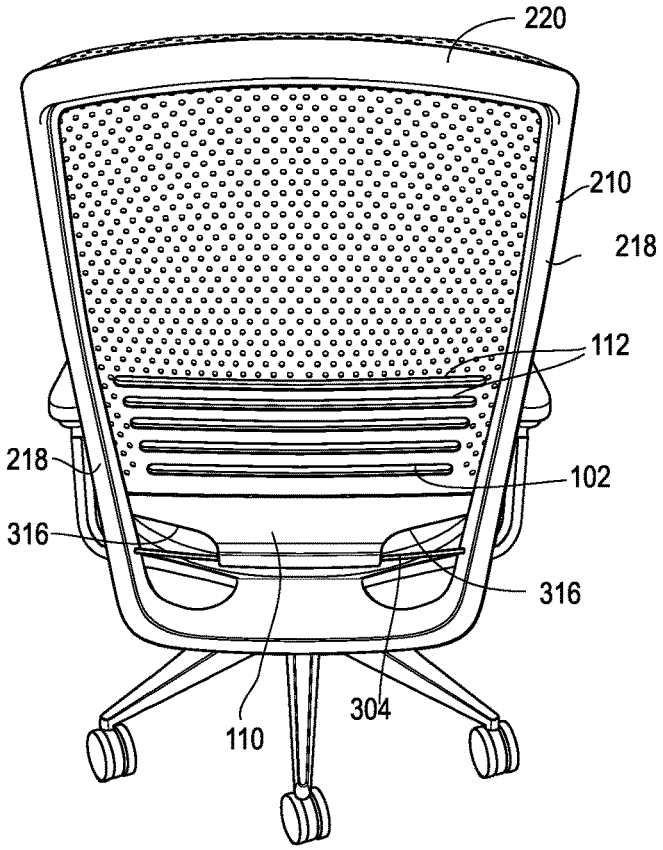
FIG. 9 is a rear view of a chair incorporating the backrest of FIGS. 7 and 8.

In one embodiment, the leaf spring 304 includes a pair of outboard segments 318 and an intermediate segment 320, with each segment 318 extending from one of the support locations to the center portion 314. The center portion 314 may define in part the leaf spring, with or without the segment 320. In another embodiment, the leaf spring 304 extends the entire distance D1 between the support locations, and is defined as an integral, homogenous spring member between those support locations. In other words, the segments 318, 320 define a unitary member. The center portion 314 may be fixedly secured to the leaf spring 314, meaning the center portion is not pivotally or rotatably connected to the leaf spring. In other embodiments, the center portion 314 includes a hub, or wraps around the leaf spring 304, such that the center portion, and flexible shell, may rotate relative to the leaf spring, as shown for example in FIG. 7. In various embodiments, the leaf spring may be made of metal, for example a metal rod or wire, including steel, or may have other shapes, such as a blade having a rectangular cross-section, and be made of glass reinforced plastic, as shown for example in FIG. 5. In other embodiments, the leaf spring may be made of various composite materials, including a combination of metal rods and plastic. When configured as a rod, or with a cylindrical shape, the leaf spring exhibits the same bending and torque resistance in all directions radial or orthogonal to the longitudinal axis 306.

In one embodiment, the leaf spring is bow-shaped, or curved, in an unloaded configuration, as shown for example in FIG. 4, wherein the leaf spring has an upwardly facing concave curvature. In other words, the leaf spring is bowed downwardly, and may be bowed slightly rearwardly, such that the leaf spring is configured with the longitudinal axis 306 being curved. For example the curved leaf spring may lie in plane that may be vertical, or inclined relative to vertical, for example at 45 degrees or less (with the plane extending upwardly and forwardly above the longitudinal axis), and preferably at 30 degrees or less, although greater or lesser angles may be suitable. The phrase "unloaded configuration" refers to the state of the leaf spring when no load is being applied thereto by a user engaging the backrest, although the leaf spring may be preloaded by way of assembly or installation. For example, the ends of the spring may be configured with a bent portion 326 disposed in an interior cavity 324 defined by the back support upright 324. For example, the bent portion 326 may be defined by ends of the leaf springs being turned, or otherwise configured with a first stop 330 that engages a first stop surface 328 defined by the support frame on one side of the cavity and preloads the leaf spring. The bent portion 326 may also include a second stop 332 that engages a second stop surface 334 defined by the support frame on an opposite side of the cavity to prevent the leaf spring from being pulled out of the frame, or support locations, for example when the back support and leaf spring are undergoing maximum deflection in a loaded configuration, which refers to a load being applied to the backrest by the user, which is transmitted to the leaf spring through the shell and/or back frame.

In one embodiment, the back support 212 and support frame 100 have a greater length than the distance defined between the first/second support locations and the third support location, such that the back support and support frame are bowed forwardly with a forwardly facing convex shape defined along a vertical plane. Due to this curvature, and the resilience of the back support and support frame, the back support and support frame apply a preload to the leaf spring to create the curvature in the leaf spring in the unloaded configuration.

The leaf spring 304 may also be have a forwardly facing concave curvature, or may have a rearwardly and/or downwardly facing concave curvature, all in an unloaded configuration, albeit preloaded. It should be understood that the leaf spring may be applied to the bottom of the back support 100, for example the bottom edge 120 thereof as shown in FIG. 3, with the back support flexing and transmitting a load to the leaf spring 304.

During recline, the leaf spring 304 is moveable between the unloaded configuration and the loaded configuration, wherein the leaf spring flexes or bends. In one embodiment, the leaf spring is linear in the unloaded configuration and is bow-shaped in the loaded configuration. In other embodiments, the leaf spring is bow-shaped in both the unloaded and loaded configurations, with the leaf spring being more or less curved in the loaded configuration than in the unloaded configuration, which may include application of a preload.

Figure 10A:
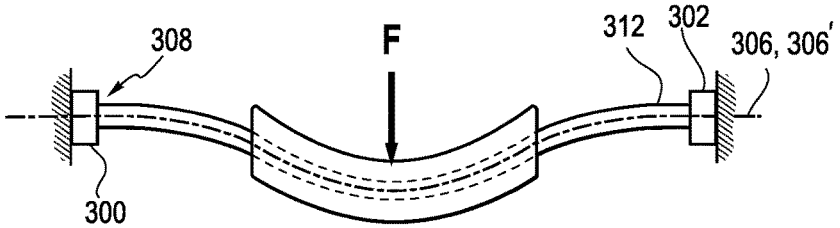
FIGS. 10A and B are schematic views of a leaf spring in a flexed configuration being fixedly and simply supported by a frame respectively.
Figure 10B:
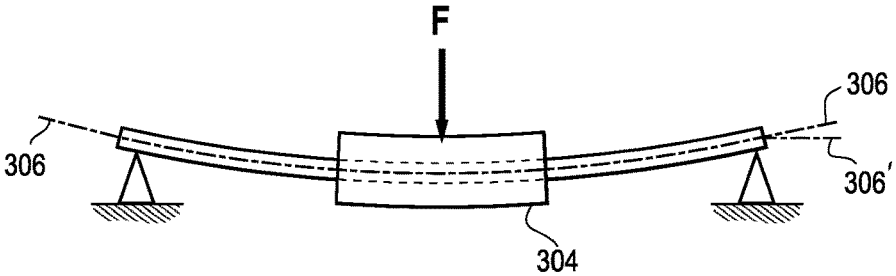
Figure 11:
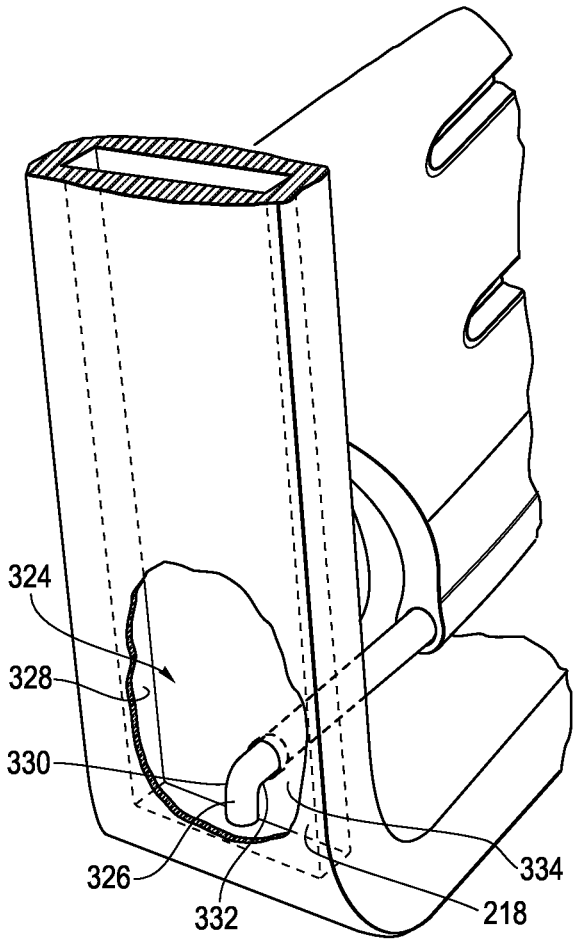
FIG. 11 is a schematic view showing an interface between a leaf spring and a frame.

Referring to FIG. 10A, the leaf spring 304 may be simply supported at the first and second ends of the leaf spring, while in FIG. 10B, the leaf spring 304 is shown as being fixedly supported at the first and second ends of the leaf spring. In one embodiment, the first and second ends 308, 312 are moveable relative to the first and second support locations 300, 302. For example, the first and second ends 308, 312 may be translatable along the longitudinal axis 306 relative to the first and second support locations 300, 302, for example by axial movement in and out through apertures 350 defined in side walls 352 of the support frame and communicating with the cavity 324. The ends of the leaf springs may be turned, or otherwise configured with a stop, to prevent the leaf spring from being pulled out of the frame, or support locations, as described above. In another embodiment, the first and second ends 308, 312 are rotatable about the longitudinal axis 306 relative to the first and second support locations. In yet another embodiment, the first and second ends 308, 312 are translatable along, and rotatable about, the longitudinal axis 306 relative to the first and second support locations 300, 302.

Operation

In operation, and referring to FIGS. 10A and B, a user may sit in the body support structure 10 and apply a force F against the backrest. As the user applies various forces against the backrest, the back support 212 shell or support frame 100 may flex, for example at the lumbar region, with the back support 212 shell or support frame 100 pivoting about the upper, thirds support locations 310 and with the bottom portion applying a force to the leaf spring 304, which may flex in response thereto while providing a biasing force to resist the force applied by the user. For example, the bottom portion 110 may move rearwardly and downwardly as the user flexes their back and presses against the lumbar region, while the lumbar region flexes from a forwardly-facing convex shape to a flatter or more planar shape. When the load F is relieved, the leaf spring 304 returns the backrest to a nominal position. The ends of the leaf spring may translate relative to the back frame to accommodate the displacement of the spring relative to the support locations, 300, 302, or the back frame, or upright portions thereof, may deflect slightly inwardly to accommodate the displacement.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A body support member comprising:

a frame comprising laterally spaced apart first and second support locations and a laterally extending uppermost cross member;

a leaf spring having a longitudinal axis and extending between the first and second support locations, wherein the leaf spring comprises opposite first and second ends coupled to the frame along the longitudinal axis; and a flexible shell pivotally coupled to the frame at a third support location on the uppermost cross member, wherein the third support location is longitudinally spaced apart from the first and second support locations, wherein the flexible shell is coupled to the leaf spring between the first and second support locations, and wherein the flexible shell is disposed in front of the uppermost cross member and comprises an upper edge vertically spaced above the uppermost cross member.

2. The body support member of claim 1 wherein the leaf spring is bow-shaped in an unloaded configuration.

3. The body support member of claim 1 wherein the longitudinal axis is curved when the leaf spring is in an unloaded configuration.

4. The body support member of claim 1 wherein the leaf spring comprises a rod.

5. The body support member of claim 1 wherein the rod is cylindrical.

6. The body support member of claim 1 wherein the leaf spring is moveable between an unloaded configuration and a loaded configuration, wherein the leaf spring is linear in the unloaded configuration and wherein the leaf spring is bow-shaped in the loaded configuration.

7. The body support member of claim 1 wherein the leaf spring is simply supported at the first and second ends of the leaf spring.

8. The body support member of claim 1 wherein the leaf spring is fixedly supported at the first and second ends of the leaf spring.

9. The body support member of claim 1 wherein the first and second ends are moveable relative to the first and second support locations.

10. The body support member of claim 9 wherein the first and second ends are translatable along the longitudinal axis relative to the first and second support locations.

11. The body support member of claim 9 wherein the first and second ends are rotatable about the longitudinal axis relative to the first and second support locations.

12. The body support member of claim 9 wherein the first and second ends are translatable along, and rotatable about, the longitudinal axis relative to the first and second support locations.

13. The body support member of claim 1 wherein the third support location comprises a pair of laterally spaced third support locations.

14. The body support member of claim 1 wherein the flexible shell is pivotally coupled to the support frame at the third support location.

15. A body support member comprising:

a frame comprising laterally spaced apart first and second support locations and a laterally extending uppermost cross member;

a leaf spring extending between and simply supported by the frame at the first and second support locations; and a flexible shell pivotally coupled to the frame at a third support location on the uppermost cross member, wherein the third support location is longitudinally spaced apart from the first and second support locations, wherein the flexible shell is coupled to the leaf spring between the first and second support locations, and wherein the flexible shell is disposed in front of the uppermost cross member and comprises an upper edge vertically spaced above the uppermost cross member.

16. The body support member of claim 15 wherein the leaf spring is bow-shaped in an unloaded configuration.

17. The body support member of claim 15 wherein the leaf spring comprises a longitudinal axis, wherein the longitudinal axis is curved when the leaf spring is in an unloaded configuration.

18. The body support member of claim 15 wherein the leaf spring comprises a rod.

19. The body support member of claim 18 wherein the rod is cylindrical.

20. The body support member of claim 15 where in the leaf spring is moveable between an unloaded configuration and a loaded configuration, wherein the leaf spring is linear in the unloaded configuration and wherein the leaf spring is bow-shaped in the loaded configuration.

21. The body support member of claim 15 wherein the leaf spring comprises first and second ends moveable relative to the first and second support locations.

22. The body support member of claim 21 wherein the first and second ends are translatable along a longitudinal axis of the spring relative to the first and second support locations.

23. The body support member of claim 21 wherein the first and second ends are rotatable about the longitudinal axis relative to the first and second support locations.

24. The body support member of claim 21 wherein the first and second ends are translatable along, and rotatable about, the longitudinal axis relative to the first and second support locations.

25. The body support member of claim 15 wherein the third support location comprises a pair of laterally spaced third support locations.

26. The body support member of claim 15 wherein the flexible shell is pivotally coupled to the support frame at the third support location.

27. A body support member comprising:

a frame comprising laterally spaced apart first and second support locations and a laterally extending uppermost cross member;

a leaf spring extending between and fixedly connected to the frame at the first and second support locations; and a flexible shell pivotally coupled to the frame at a third support location on the uppermost cross member, wherein the third support location is longitudinally spaced apart from the first and second support locations, wherein the flexible shell is coupled to the leaf spring between the first and second support locations, and wherein the flexible shell is disposed in front of the uppermost cross member and comprises an upper edge vertically spaced above the uppermost cross member.

* * * * *